United States Patent [19]

Peterson

[11] 4,098,207

[45] Jul. 4, 1978

[54] ELECTROMECHANICAL NEEDLE BAR ENGAGING DEVICE

[75] Inventor: Wesley Robinson Peterson, Bound Brook, N.J.

[73] Assignee: The Singer Company, New York, N.Y.

[21] Appl. No.: 791,116

[22] Filed: Apr. 26, 1977

[51] Int. Cl.[2] ..... D05B 55/16

[52] U.S. Cl. ..... 112/221

[58] Field of Search ..... 112/221, 220, 158 R, 112/79 R, 79 A

[56] References Cited

U.S. PATENT DOCUMENTS

| | | | |
|---|---|---|---|
| 2,989,014 | 6/1961 | Dedman | 112/221 X |
| 3,259,088 | 7/1966 | Rockholt | 112/221 X |
| 3,502,044 | 3/1970 | Brown et al. | 112/79 R |
| 3,641,955 | 2/1972 | Brown et al. | 112/221 X |
| 3,872,809 | 3/1975 | Adams et al. | 112/221 |

*Primary Examiner*—H. Hampton Hunter

*Attorney, Agent, or Firm*—Edward P. Schmidt; Edward L. Bell; Robert E. Smith

[57] ABSTRACT

An electromechanical needle bar engaging device having a latch release member normally urged by biasing means into engagement with a coupling member, to unlatch the coupling member from a needle bar drive member. The latch release member sewing machine frame supports a solenoid adjacent the latch release member, which, when activated, rotates a lever supported on the latch release member, into the path of motion of the needle bar drive member. Movement of the needle bar drive member against the lever will move the lever and the latch release member on which it is supported out of engagement with the coupling member to permit the coupling member to relatch itself with the needle bar drive member. Means are provided utilizing the solenoid as an electromagnet to retain the latch release member out of engagement with the coupling member.

3 Claims, 6 Drawing Figures

ELECTROMECHANICAL NEEDLE BAR ENGAGING DEVICE

BACKGROUND OF THE INVENTION

This invention relates to devices for interrupting the regular formation of stitches in a sewing machine and more particularly to a solenoid actuated needle bar engaging mechanism in a skip-stitch device.

The usual skip-stitch device in a sewing machine is normally dormant during regular sewing and is generally activated only when a basting operation is required. Thus as it is shown in the U.S. Pat. Nos. 3,559,601 issued Feb. 2, 1971, and 3,782,311 issued Jan. 1, 1974, needle bar endwise reciprocation can be interrupted by causing the needle bar to undergo a lateral excursion beyond the normal range of sewing machine zig-zag motion.

However with the advent of the electronically controlled sewing machines it has been found desirable and necessary to have needle bar endwise reciprocation controlled for reasons other than basting. For example, by interrupting needle bar endwise reciprocation at the instant of selection of a new pattern, placement of a stitch related to the old pattern may be avoided. To accomplish this it is necessary to separate the needle bar from its drive means without the necessity for the extreme excursion required in the prior art devices. This was accomplished as disclosed in U.S. Pat. No. 3,872,809, issued Mar. 25, 1975, by having a solenoid responsive to an electrical signal to pivot a latch release member into engagement with a coupling member to unlatch the coupling member from the needle bar drive member.

The arrangement disclosed in the last noted patent above has been entirely adequate in its application in a sewing machine to effect basting stitches or to disconnect a needle bar concurrent with new pattern selection. It has been noted, however, the continuous actuation of the solenoid during basting results in substantial generation of heat. Also, due to the direct nature of operation of the solenoid, a fairly large device is required.

What is required is a basting stitch mechanism activated by electrical signals so as to be compatible with an electronic control device, which is small in size and with a very low power consumption.

SUMMARY OF THE INVENTION

The present invention satisfies the above requirements in a device designed to engage a needle bar with its drive mechanism, from a normally disengaged state. This is a departure from the usual means separating a needle bar from its drive mechanism from a normally engaged state. As in the prior art devices a coupling member is attached to the needle bar, and carries a latch member which engages with a drive member slidably supported on the needle bar to be retained in intimate contact therewith. An interposer lever is supported on the coupling member to extend between the latch member and a latch release member. The latch release member is biased in a direction normally to urge the interposer lever and the latch member into a position out of engagement with the drive member, whereby no movement of the drive member will be transferred to the coupling member and the needle bar to which it is attached. A small solenoid is supported by the sewing machine frame adjacent the latch release member, which, when activated, actuates a lever also carried by the latch release member and pivoted thereto. A small torsion spring biases the lever to a stored position. Activating the solenoid pivot lever against the bias of the torsion spring to a position in the path of reciprocation of the drive member sliding on the needle bar. The endwise reciprocation of the drive member by the actuating means of the sewing machine will urge the lever and the latch release member to which it is attached to a position out of engagement with the interposer lever, permitting the latch member to be urged by a second biasing means to a position clasping the drive member to the coupling member, thereby to occasion endwise reciprocation of the needle bar. The solenoid supported on the sewing machine frame need only be of a size and strength sufficient to rotate the lever against the torsion spring. The effort required to engage the coupling member of the needle bar with the driving member is effected by the main actuating means of a sewing machine operating through the driving member.

DESCRIPTION OF THE DRAWINGS

With the above and additional objects and advantages in view as will hereinafter appear, this invention comprises the devices, combinations and arrangements of parts hereinafter described and illustrated in the accompanying drawings of a preferred embodiment in which.

DESCRIPTION OF A PREFERRED EMBODIMENT

Figure 1:
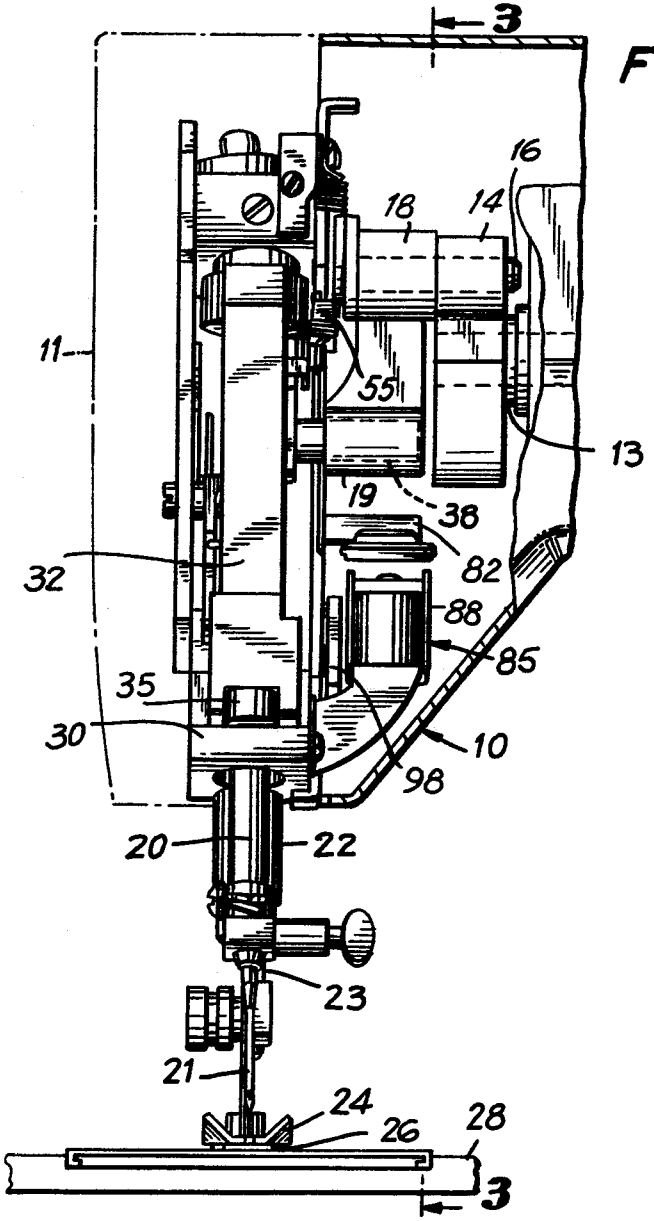
FIG. 1 is a front elevational view of the head portion of a sewing machine in which the invention has been incorporated.

Referring to FIG. 1 there is shown a head end portion 10 of a sewing machine partially in section and with the front cover 11 thereof shown in phantom to reveal internal detail. There is visible the arm shaft 13 terminating in crank 14, the crank connected by pin 16 to connecting link 18 for endwise reciprocation of needle bar 20 in a manner well known in the sewing machine art. Supported in the head end portion 10 by a bushing 22 located behind the needle bar 20 is a presser bar 23 terminating in a presser foot 24. As is normal in the sewing machine art, means are provided to urge the presser foot 24 against feed dogs 26, part of a feed system (not shown) located in the bed 28 of the sewing machine.

Figure 2:
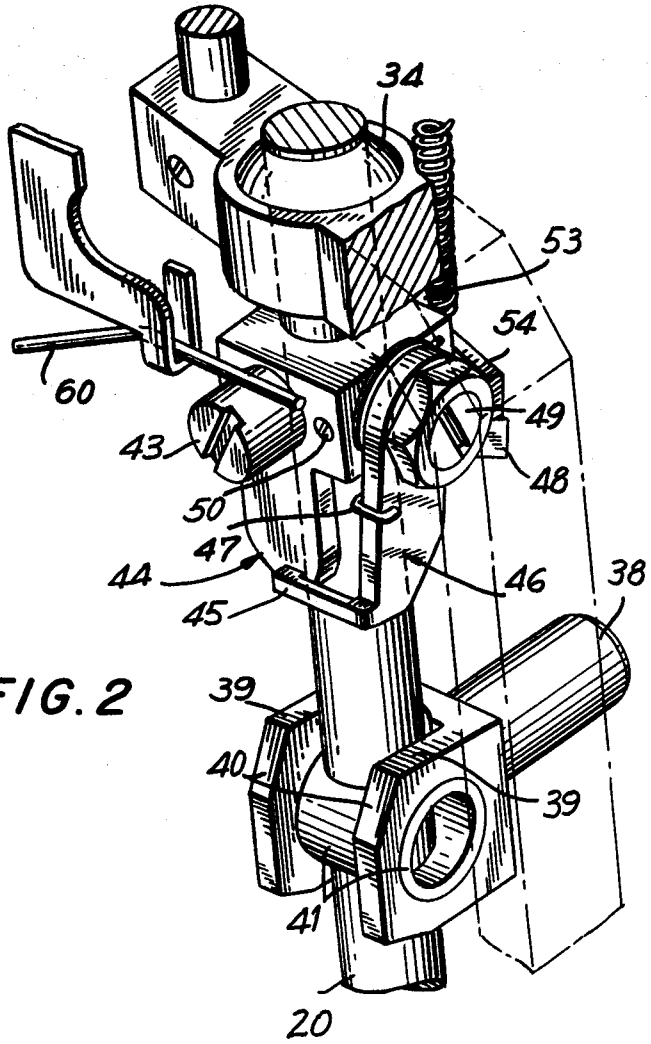
FIG. 2 is a perspective view of the upper half of needle bar and gate showing the latch mechanism attached to the needle bar in the disengaged position with respect to the driving mechanism causing needle bar reciprocation.
Figure 3:
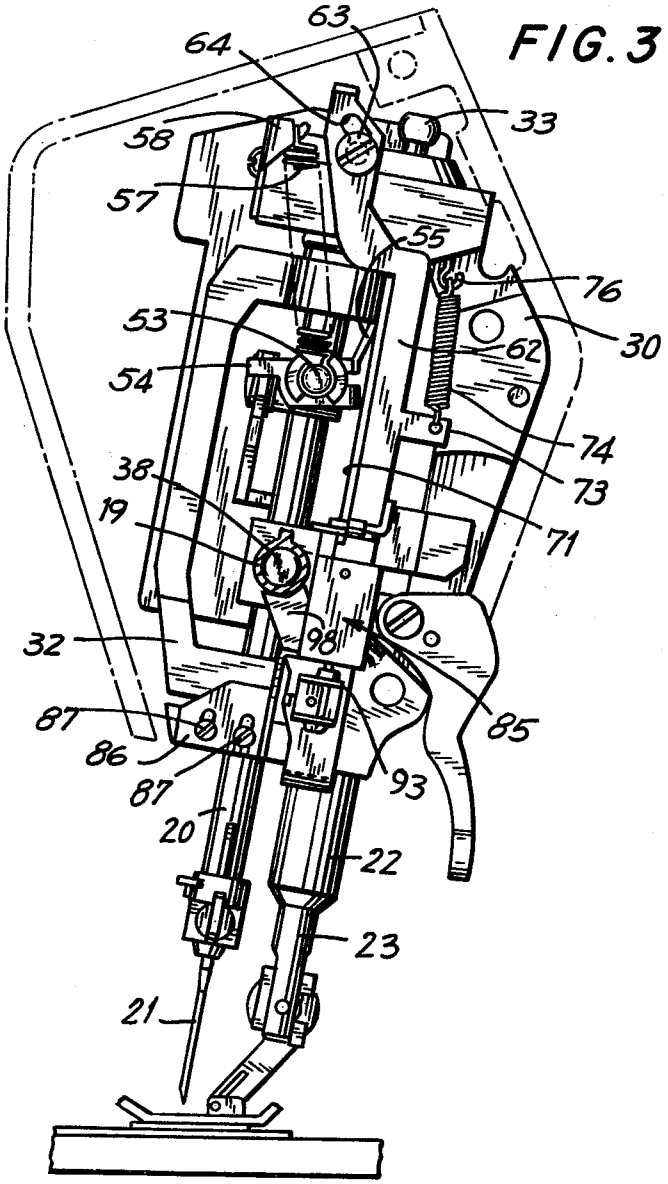
FIG. 3 is an elevational view taken substantially along the line 3—3 of FIG. 1, of the sewing head portion detached from the sewing machine and viewed from the interior of the sewing machine showing the invention as initially activated.

Referring to FIG. 3, the details of the support for the needle bar 20 and the presser bar 23 are shown more clearly. A bracket 30, which may be part of the sewing machine head end portion 10, supports a C-shaped needle bar gate 32 within which the needle bar 20 undergoes endwise reciprocation. The needle bar gate 32 pivots between an upper spherical bearing 34 (see FIG. 2) and lower spherical bearing 35 (see FIG. 1), resulting in lateral positioning of the sewing needle 21 affixed to the needle bar 20 when the needle bar gate 32 is urged to rotate about the spherical bearings by means of the driving post 33.

The details of the needle bar drive arrangement may be better understood by reference to FIG. 2. Thus the connecting link 18 which has its upper end connected to the pin 16 attached to the crank 14, has its lower bushing 19 connected to a driving stud 38. The opposite end of the driving stud 38 terminates in a pair of cheek pieces 40 carrying a collar 41 which is transversely bored to slidably accommodate the needle bar 20. The needle bar 20 has affixed thereto by stud 43 a coupling member 44. Supported on a forwardly disposed surface of the coupling member 44 is a latch 46, normally urged by torsion spring 47 to a counter-clockwise direction as viewed in FIG. 2. The latch 46 is carried on an eccentric stud 49, a selected eccentric position of which may be locked by set screw 50. Such a selected position for the eccentric stud 49 would be achieved, for example, when the upper surfaces 39 of the cheek pieces 40 are in intimate contact with the coupling member 44 and the rearwardly turned arm 45 of the latch 46 is in intimate contact with the lower surface of the forwardly disposed cheek piece 40. In this fashion relative movement between the driving stud 38 and the coupling member 44 is minimized.

The latch 46 is further formed with a laterally extending arm 48. A surface of the coupling member 44, adjacent that supporting the latch 46, supports on a stud 53 an interposer lever 54, one end of which coacts with the laterally extending arm 48 of the latch 46. By an inspection of FIG. 3 and FIG. 2, it may be noted that counter-clockwise rotation of the interposer lever 54, as viewed in FIG. 3, will cause separation of the rearwardly turned arm 45 of the latch 46 from the lower surface of the cheek piece 40, permitting the driving stud to freely slide on the needle bar 20. In order to forestall repeated impact of the driving stud 38 on the coupling member 44 with continued machine operation, a tension spring 57 extends from the stud 53 affixed to the coupling member, to a support piece 58 affixed to an upper portion of the bracket 30. Thus whenever the latch 46 is disconnected from the cheek piece 40 of the driving stud 38, the needle bar 20 is drawn to an elevated position where the impact between the driving stud 38 and the coupling member 44 will be minimized. An adjustable spring bar 60 (see FIG. 2), which impinges on the stud 43 affixing the coupling member 44 to the needle bar 20, operates in opposition to the tension spring 57 to limit the upward motion of the needle bar 20 to a position where relatching of the coupling member to the driving stud 38 is possible.

Referring once again to FIG. 3, it will be noted that the interposer lever 54 is fashioned on a rearwardly disposed edge thereof with an arm 55 extending at right angles to the interposer lever and in a generally upward direction (see also FIG. 1). The upper edge of the arm 55 of the interposer lever 54 abuts a latch release member 62, which extends substantially parallel to the patch of reciprocation of the needle bar 20. The latch release member 62 is supported on the bracket 30 by means of a shouldered screw 63 extending through a slot 64 in the upper end of the latch release member, and by a stud 66 affixed to the bracket which extends through a slot 68 in the lower portion of the latch release member (see FIG. 5) and retained by ring 69. The slots 64, 68 in the latch release member 62 are both fashioned with angular portions to effect a forward shifting of the latch release member 62 with upward motion thereof. In this fashion upward motion of the latch release member 62 will cause a forwardly disposed edge 71 thereof to strike the arm 55 of the interposer lever 54, causing counter-clockwise rotation of the interposer lever 54, with resultent clockwise rotation of the latch 46 and separation of the rearwardly turned arm 45 thereof from the cheek piece 40 of the driving stud 38. A rearwardly disposed lug 73 of the latch release member 62 receives in an opening therein one end of extension spring 74, the other end of which is captured by a hook 76 affixed to bracket 30 above the lug, thereby biasing the latch release member upwardly to a position where it will be normally effective to separate the needle bar 20 from the driving stud 38.

Figure 5:
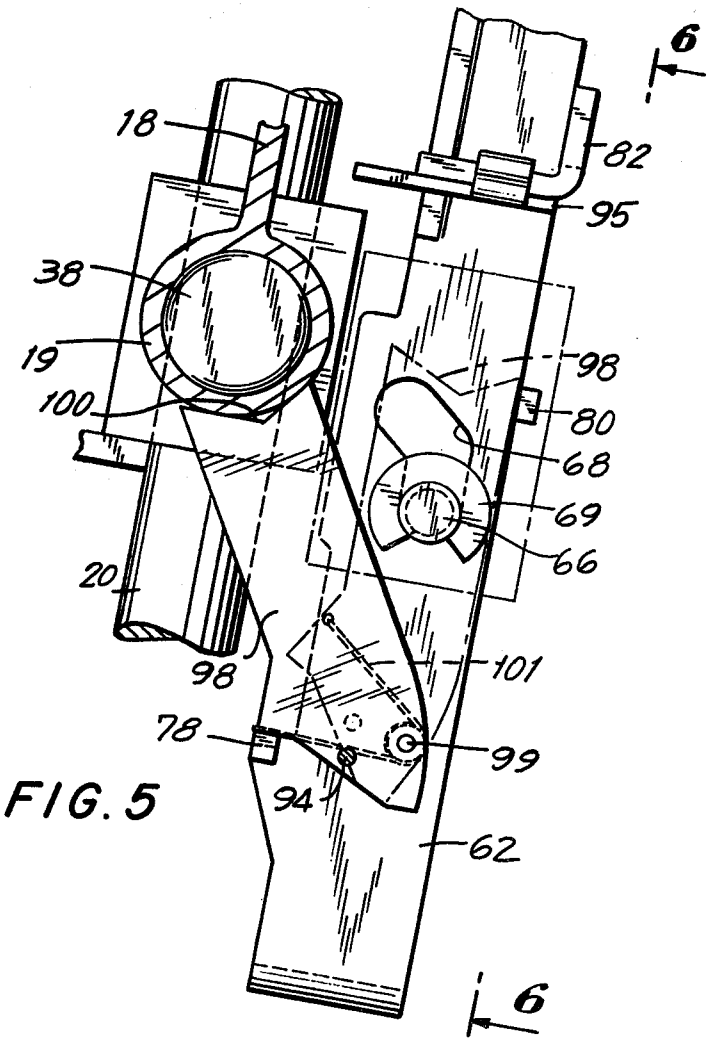
FIG. 5 is a detached and enlarged elevational view of a portion of FIG. 3 with the solenoid removed to show details of the invention; and, FIG. 6 is an elevational view taken substantially along the line 6—6 of FIG. 5 to show further details of the invention.
Figure 4:
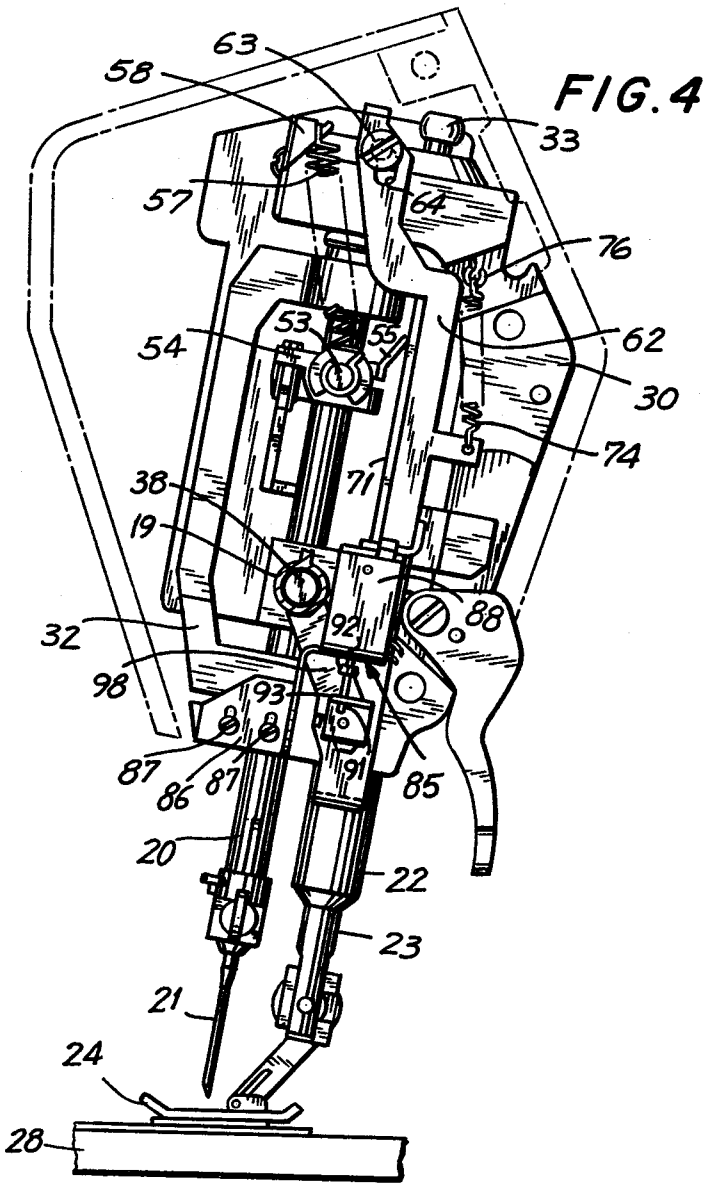
FIG. 4 is an elevational view similar to FIG. 3 showing the invention in the engaged position.

Referring to FIGS. 1, 3 and 4, there is evident a solenoid assembly 85 with an integral support member 86 affixed to the bracket 30 by means of screws 87. The coil 89 (see FIG. 6) of the solenoid assembly 85 is sustained adjacent the latch release member 62 by the integral support member 86. An armature 91 extends downwardly from the coil 89 through an opening in a pivot bracket 93. A collar 92 affixed to the armature 91 exceeds the size of the opening in the pivot bracket, thereby transferring any motion of the armature 91 to the pivot bracket. The pivot bracket 93 is supported by a pivot pin 94 affixed thereto and extending laterally through an opening in a latching lever 98 which is itself pivotably supported on pin 99 affixed to and laterally extending from the latch release member 62. By design, the pivot pin 94 affixed to the pivot bracket 93 is spaced from the pin 99 on which the latching lever 98 is pivoted, in a direction substantially transverse of the axial movement of the armature 91. Thus as the coil 89 of the solenoid assembly 85 is activated by the application of electric current via the leads 90, the armature 91 will be urged downwardly as viewed in FIG. 6, causing a counter-clockwise moment to be imparted to the latching lever 98 as viewed in FIG. 5, due to the spacing of the pivot pin 94 from the pin 99 on which the latching lever is pivoted. In order to retain the latching lever 98 in a normally stored position, a light torsion spring 101, visible in FIGS. 5 and 6, may be employed. One end of the torsion spring 101 may extend through an opening provided therefor in the latching lever 98, while the second end of the torsion spring may be biased against a bar 78 formed as part of the latch release member 62 to extend into the path of the latching lever 98 for the purpose of limiting the counter-clockwise motion of the latching lever and for transferring force transmitted by the latching lever to the latch release member 62, as will be apparent below. In FIG. 5, the position of the latching lever 98 when the coil 89 of the solenoid assembly 85 is not activated, is shown in phantom, as urged by the torsion spring 101 into engagement with stop 80, also formed as part of the latch release member 62 to extend into the path of pivotal motion of the latching lever.

It is apparent thus far that the solenoid assembly 85 must have sufficient strength primarily to overcome the resistence of the torsion spring 101. The torsion spring 101 need have sufficient strength only to return the latching lever 98 to the normally stored position shown in phantom in FIG. 5. The latching lever 98 is itself ideally fashioned from a lightweight and resilient material such as plastic. The desirability of such a material will be better understood by reference to remainder of the specification describing the operation of the invention.

In FIG. 3, the coupling member 44 and needle bar 20 are shown retained in an elevated state by the tension spring 57, and separated from the cheek pieces 40 of the driving stud 38 because of the forward shift of the latch release member 62 under the influence of the extension spring 74 as hereinabove described. Thus the forwardly disposed edge 71 of the latch release member 62 engages with the arm 55 of interposer lever 54, causing the interposer lever to rotate counter-clockwise, as viewed in FIG. 3, and interact with laterally extending arm 48 of the latch 46, resulting in disengagement of the rearwardly turned arm 45 of the latch from the forwardly disposed cheek piece 40 of the driving stud 38. In FIG. 3, the latching lever 98 is shown in its most counter-clockwise position as placed by the armature 91 due to activation of the coil 89, also as hereinabove described. Thus disposed, the latching lever 98 has a V-shaped extremity 100 thereof, extended into the path of reciprocation of the driving stud 38, which continues reciprocating under the influence of the sewing machine actuating means through the connecting link 18, slidably along the needle bar 20. The linear motion of the driving stud 38 sliding along the needle bar 20, brings the lower bushing 19 of the connecting link 18 into contact with the V-shaped extremity 100 of the latching lever 98, the initial contact being shown in FIG. 3. Continued downward movement of the driving stud 38, as urged by the lower bushing 19 of the connecting link 18, results in movement of the latching lever 98 and the latch release member 62, by virtue of connection thereto through pin 99 and bar 78, to a position as shown in FIG. 4. In FIG. 4, the lower bushing 19 and the driving stud 38 are at their lowermost position, as is the latch release member 62. Thus, the main actuating means for the sewing machine has been utilized to urge the latch release member 62 into its most downwardly position against the upward bias imposed thereto by the extension spring 74. It is apparent that the latching lever 98 is preferably of a resilient material to minimize shock of engagement with the lower bushing 19 of the connecting link 18.

Figure 6:
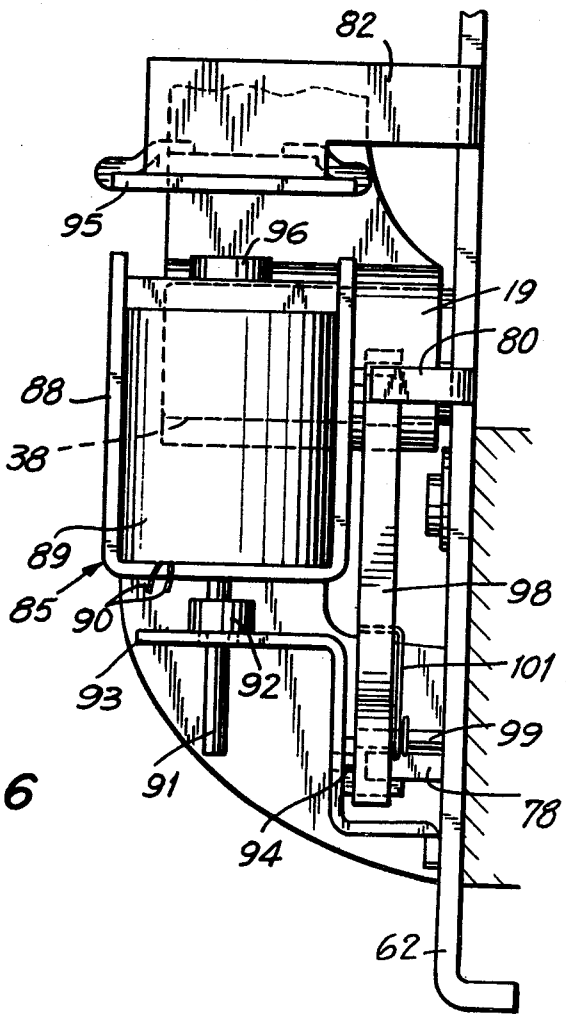

There is provided on the latch release member 62 a lateral extension 82 supporting a floating plate 95 (see FIG. 6). The solenoid assembly 85 includes a coil frame 88, an extension of which form the integral support member 86 supporting the solenoid assembly from the bracket 30. The coil frame 88 extends upwardly of the coil 89 a distance sufficient to be even with a pole piece 96 centrally located within the coil. The latch release member 62, as placed by the interaction of the lower bushing 19 of the connecting link 18 with the latching lever 98, has the lateral extension 82 thereof arranged so that the floating latch plate 95 extends across coil frame 88. The latch plate 95 is made floating to permit a self-seeking contact with the coil frame 88 and the pole piece 96. The solenoid assembly 85, which had insufficient strength to draw the latch release member 62 downwardly against the urgings of the extension spring 74, now becomes an electro magnet with sufficient strength to retain the latch release member thus downwardly urged in a lowered state. With the forwardly disposed edge 71 of the latch release member 62 with drawn from contact with the arm 55 of the interposer lever 54, the latch 46 supported on the coupling member 44 will rotate in a counter-clockwise direction as viewed in FIG. 2, due to the torsion spring 47; and will relatch with the forwardly disposed cheek piece 40 of the driving stud 38 when the driving stud slides up the needle bar 20 to bring the upper surfaces 39 of the cheek piece 40 into contact with the coupling member 44 affixed to the neddle bar, under the urgings of the main actuating means of the sewing machine as applied by the connecting link 18. Endwise reciprocation of the needle bar 20 will thereby result until the coil 89 is deactivated by removal of voltage from the leads 90 thereof. With power removed from the coil 90, the electro magnetic latching of the coil ceases, and the latch release member 62 is moved upwardly under the urgings of the extension spring 74, causing the forwardly disposed edge of the latch release member to strike the arm 55 of interposer lever resulting in the removal of the rearwardly turned arm 45 of the latch 46 from engagement with the cheek piece of the driving stud 38.

Having thus set forth the nature of the invention what is sought to be claimed is:

1. A sewing machine having a frame, an endwise reciprocal needle bar supported by said frame, latch mechanism carried by said needle bar, actuating means operating through said latch mechanism for influencing endwise reciprocal motion of said needle bar, means for normally disengaging said latch mechanism from said actuating means, means driven by said actuating mechanism for engaging said latch mechanism to said actuating means, and means for retaining said engaging means with said latch mechanism engaged to said actuating means.

2. A needle bar engaging device for a sewing machine having an endwise reciprocal needle bar, frame means accommodating the reciprocatory movement of said needle bar, a reciprocatory drive member slidably mounted on said needle bar, actuating means for said drive member, a coupling member affixed to said needle bar for continuous movement with said needle bar, said coupling member including latching means for connecting said coupling member to said drive member to transmit reciprocatory movement of said drive member to said needle bar, latch release means mounted on said frame means for selective movement from a position disconnecting said latch means of said coupling member from said drive member, wherein the improvement comprises: biasing means for continuously urging said latch release means to a position for disconnecting said latching means; a solenoid member supported on said frame means; abutment means supported on said latch release means and actuated by said solenoid member when activated to extend into the path of reciprocatory movement of said drive member for urging said latch release means out of said position disconnecting said latching means against the urgings of said biasing means; and a latch plate means carried by said latch release means for cooperating with said solenoid member used as an electro magnet to retain said latch release means from said disconnecting position in opposition to said biasing means.

3. A needle bar engaging device for a sewing machine comprising: an endwise reciprocal needle bar; frame means for accommodating a reciprocal movement of said needle bar; a reciprocating drive member slidably mounted on said needle bar; a coupling member affixed to said needle bar for continuous movement with said needle bar, said coupling member including latching means for connecting said coupling member to said drive member to transmit reciprocating movement of said drive member to said needle bar, said latching means including a latch extension movable in a first direction toward said drive member to permit said coupling member to connect to said drive member, said latch extension being movable in a second direction away from said drive member to permit said coupling member to disconnect from said drive member, said latching means further including first biasing means for urging said latch extension to move in said first direction; latch release means mounted on said frame means for selective movement against said latching means to move said latch extension in said second direction; second biasing means continuously urging said latch release means in contact with said latching means and urging said latch extension in said second direction against the urgings of said first biasing means; a solenoid member supported on said frame means; and abutment means supported on said latch release member in a position to be urged by said solenoid member, when activated, from a first position out of the reciprocating path of movement of said drive member to a second position in the reciprocating path of movement of said drive member for influencing movement of said latch release means against the urgings of said second biasing means to release said latch extension to move in said first direction; third biasing means urging said lever normally to said first position; and latch plate means carried by said latch release means for cooperating with said solenoid member used as an electro magnet to retain said latch release means in a position releasing said latch extension to move in said first direction.

* * * * *